United States Patent [19]

Kopsé et al.

[11] Patent Number: 4,461,427

[45] Date of Patent: Jul. 24, 1984

[54] FUEL INJECTION NOZZLE

[75] Inventors: Odon Kopsé, Utzenstorf, Switzerland; Néstor Rodriguez-Amaya, Stuttgart, Fed. Rep. of Germany

[73] Assignee: Robert Bosch GmbH, Stuttgart, Fed. Rep. of Germany

[21] Appl. No.: 347,814

[22] Filed: Feb. 11, 1982

[30] Foreign Application Priority Data

Feb. 17, 1981 [DE] Fed. Rep. of Germany ..... 3105671

[51] Int. Cl.[3] ..... F02M 45/08

[52] U.S. Cl. ..... 239/533.5; 239/533.9

[58] Field of Search ..... 239/533.3–533.12, 239/584

[56] References Cited

U.S. PATENT DOCUMENTS

| | | | |
|---|---|---|---|
| 3,450,351 | 6/1969 | Messerschmidt | 239/533.3 |
| 3,511,442 | 5/1970 | DeLuca et al. | 239/533.3 |
| 3,817,456 | 6/1974 | Schlappkohl | 239/533.5 |
| 3,980,234 | 9/1976 | Bouwkamp | 239/533.3 |
| 4,215,821 | 8/1980 | Eblen | 239/533.8 |

FOREIGN PATENT DOCUMENTS

| | | | |
|---|---|---|---|
| 994588 | 11/1951 | France | 239/533.5 |

*Primary Examiner*—Andres Kasnikow
*Assistant Examiner*—Michael J. Forman
*Attorney, Agent, or Firm*—Edwin E. Greigg

[57] ABSTRACT

A fuel injection nozzle for internal combustion engines, in particular a cold-starting valve which has a valve needle opening counter to the force of a closing spring, the valve needle being additionally urged in the closing direction by an adjusting piston. The adjusting piston rests on a yielding stop formed by the closing spring. The stop is formed by the upper valve plate, which has a passageway bore for an extension tang of the adjusting piston. The extension tang forms a pre-stroke stop for the valve needle. A restoring spring is associated with the adjusting piston and is disposed inside the spring chamber, which surrounds the extension tang of the adjusting piston. At least one of the spring support plates has an inner annular wall protruding in collar-like fashion, which surrounds the engaged tang of the adjusting piston or valve needle.

11 Claims, 2 Drawing Figures

FUEL INJECTION NOZZLE

BACKGROUND OF THE INVENTION

The invention is based on a fuel injection nozzle for internal combustion engines, in particular a cold-starting valve whose valve needle opens counter to the force of a closing spring. The valve needle is also urged in the closing direction by an additional force, via an adjusting piston exposed either to the delivered fuel or to a control pressure.

In order to control the opening-stroke movement of the valve needle in fuel injection nozzles, it is known to provide an adjusting piston which on one end has a stop cooperating with the valve needle and on the other end is exposed, for example, to the fuel which is under pressure. An adjusting piston of this kind then acts as a hydraulic pre-stroke limiter; depending on the pressure of the fuel acting on the valve needle, the adjusting piston is temporarily capable of blocking the stroke movement of the needle. However, since its diameter is smaller than that of the valve needle or may be dimensioned as such, then depending upon the fuel supply output the resistance of the adjusting piston is overcome when a higher pressure is attained, and the valve needle is displaced further, for example in order to open up additional injection ports (German Offenlegungsschrift No. 27 11 902 and German Offenlegungsschrift No. 27 11 389).

The undamped movements of the adjusting piston can have the effect of increasing wear; also, at the end of injection when pressure is necessarily relieved, there is no specifically defined position for the adjusting piston, which if a hollow space forms could possibly even be sucked into the pressure line, which can result in lengthening the pre-stroke. At the onset of injection, the relative movements of the piston and the nozzle needle produce unstable behavior on the part of the system as a whole.

There is accordingly a need for a fuel injection nozzle where there are no problems associated with the support of the adjusting piston, in order generally to improve efficiency and eliminate instability and wear.

OBJECT AND SUMMARY OF THE INVENTION

The fuel injection nozzle according to the invention and having the characteristics of the main claim has the advantage over the prior art that the adjusting piston which provides hydraulic pre-stroke limitation preferably rests on the compression spring, thus providing a yielding stop. As a result, while wear is reduced, the dynamic behavior of the system is improved over that in a system having a rigid stop, since the dynamic force of the adjusting piston can provide excess pressure beyond that of the pre-stressed closing spring in order to increase the closing force and effect rapid needle closing.

Advantageous further embodiments of and improvements to the fuel injection nozzle disclosed in the main claim are possible with the characteristics recited in the dependent claims. It is particularly advantageous that a specifically defined position of the adjusting piston is attained by means of a restoring spring engaging this piston; the adjusting piston is thus unable to execute any uncontrollable movements in the intervals between the individual injection processes, and at the next pressurized phase it is assured that the adjusting piston and nozzle needle are in a stable, clearly defined position. As a result, it is also possible to satisfactorily predetermine the pre-stroke available for utilization within the context of the hydraulic pre-stroke limitation effected by the adjusting piston.

A further advantageous embodiment of the present invention is attained by the type and embodiment of the spring support plate on the valve needle; the spring support plate transmits the pressure of the closing spring to the rear end of the needle and is simultaneously also engaged by the stop in the form of the adjusting piston. Because annular protrusions on the valve plate fit together in telescoped fashion at least with the tang which forms the stop of the adjusting piston and/or in the vicinity of the valve needle, a secure, non-tilting support of the valve plate is attained as well as reduced wear. It is advantageous that the stop is formed inside the spring support plate and below the support for the closing spring for the extension of the adjusting piston.

The invention will be better understood and further objects and advantages thereof will become more apparent from the ensuing detailed description of preferred embodiments taken in conjunction with the drawing.

DESCRIPTION OF THE PREFERRED EMBODIMENTS

Figure 1:
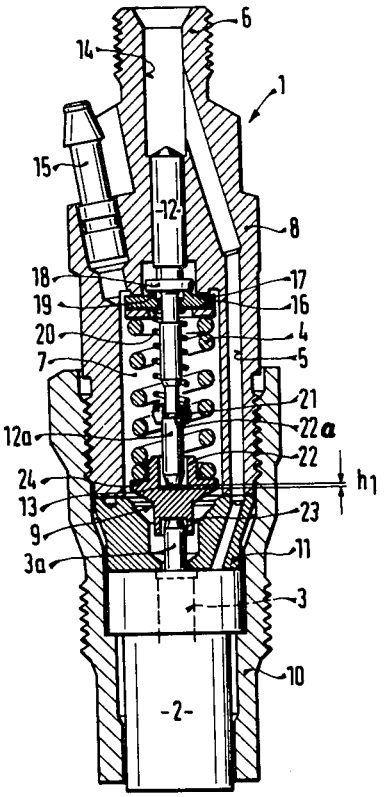
FIG. 1, in a cross-sectional view, shows a first exemplary embodiment of a fuel injection nozzle according to the invention, having a yielding stop for the adjusting piston support and a restoring spring for the adjusting piston.
Figure 2:
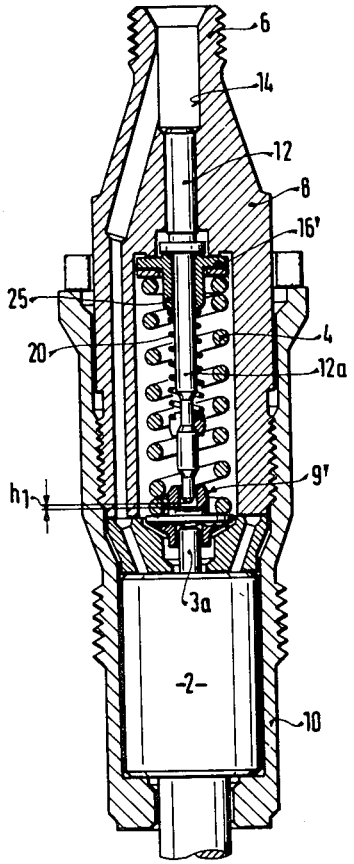
FIG. 2 shows also in cross-section view a second exemplary embodiment, in which, in essence, the spring plate in the vicinity of the adjusting piston and the valve needle are embodied differently.

FIGS. 1 and 2 each show a longitudinal section through a fuel injection nozzle according to the invention, with identical reference numerals being used in both figures for identical elements. The fuel injection nozzle 1 shown in FIGS. 1 and 2 includes a nozzle body 2, in which a valve needle 3 is disposed such that it is axially displaceable and controls injection ports, not shown in the drawings. The valve needle 3 and nozzle body 2 are also shown only schematically, since the specific embodiment of the actual nozzle area with the injection ports is of secondary importance to the invention. The nozzle may be embodied as a double nozzle, a hole-type nozzle or a tang-type nozzle, for instance, and the injection ports may be disposed axially offset from one another such that when there is a relatively low rate of fuel supply and accordingly low fuel pressure the valve needle opening stroke causes a smaller injection cross section, while at a higher fuel supply rate and a longer stroke a larger injection cross section is opened. The result, accordingly, is a pre-stroke $h_1$, determined by the movement of the valve needle up to a stop, and a total stroke which includes the pre-stoke, which results from a fixed stop for the adjusting piston or the valve needle. This point will be discussed in greater detail further on.

The valve needle 3 is loaded by a closing spring 4 and together with the nozzle body 2 defines a pressure chamber, which is not shown but which is supplied with fuel under pressure via a conduit 5 from the pressure fitting 6. The closing spring 4 is disposed in a spring chamber 7, which is formed by a nozzle holder 8; the closing spring 4 being arranged to act upon the valve needle 3 via a lower spring plate 9.

The nozzle body 2 is held on the nozzle holder 8 and tightened by a sleeve nut 10; a shim 11 may also be disposed between the nozzle body 2 and the nozzle holder 8. An adjusting piston 12 is also supported in an axially displaceable manner in the nozzle holder 8. The adjusting piston 12, via an extension tang 12*a*, cooperates with the spring support plate 9 by which the lower end of the extension tang 12*a* forms a stop 13 for the stroke (pre-stroke $h_1$) of the valve needle 3. On its other end, the adjusting piston is exposed to the fuel delivered under pressure at the fitting 6 and carried via the bore 14. The spring chamber 7 is relieved of pressure via a leakage fitting 15.

On its end remote from the valve needle 3, the closing spring 4 has a stop at an upper spring support plate 16, with an interposed shim as needed; the upper spring support plate 16 has a stop at the annular shoulder 17 of the passageway bore, formed by the nozzle holder 8, for the adjusting piston 12 or for its extension tang 12*a*. The closing spring 4 thus presses the upper valve plate 16 upward against its stop; on the other end the adjusting piston 12, as may be seen in FIGS. 1 and 2, rests on the closing spring 4 to create a yielding stop; in the illustrated exemplary embodiment, a collar 18 on the adjusting piston 12 is supported on the upper spring support plate 16, for instance on an upwardly extending inner annular protrusion 19 of the spring support plate 16.

A restoring spring 20 for the adjusting piston 12 is also provided, which in the illustrated exemplary embodiment is disposed inside the closing spring 4 and surrounding the extension tang 12*a* of the adjusting piston 12. The restoring spring 20 is embodied as a compression spring and is supported at the top (as viewed in the drawing) on the upper spring support plate 16 and also on a protruding collar of the extension tang 12*a* of the adjusting piston. In the exemplary embodiment shown, an annular holder 21 is provided for this purpose and rests at the inside on the protruding collar or on a shoulder 22*a*, which widens radially toward the outside, of the extension tang 12*a*; in its turn, the annular shoulder 21 supports the lower end of the restoring spring in an annular recess.

The fuel injection nozzles shown in FIGS. 1 and 2 function in the following manner:

As soon as fuel, supplied under pressure by an injection pump (not shown), reaches the pressure chamber formed between the valve needle 3 and the nozzle body 2, the valve needle lifts from its seat when there is sufficient pressure; the effective needle surface area in the opening direction can thus be abruptly increased, so that the valve needle 3, overcoming the pre-stroke, is displaced up to the first stop 13, provided by the lower end of the extension tang of the adjusting piston 12. At the same time, a lowermost injection port or an injection port disposed at a first level can be opened. This opening of an injection port may correspond to idling, in specific exemplary applications of the injection nozzle, or to the delivery of a first, limited amount of fuel, for instance if the injection nozzle is put to use as a cold-starting valve. The adjusting piston 12 is held continuously by its restoring spring 20 in the definite position which determines the pre-stroke $h_1$; thereby undergoes a well-defined positioning, which is maintained even if a hollow space is formed in the pressure lines during the relief at the end of injection and suction is exerted upon it. Because of the restoring spring 20, the adjusting piston 12 remains in its thusly defined stop position and keeps the pre-stroke constant, while stable operation of the total system comprising the valve needle, adjusting piston, and resultant stops is simultaneously assured.

At the same time, the adjusting piston 12 rests on the yielding stop formed by the closing spring 4 and it is only lifted up from this stop once a pressure is attained, as the supply rate of the fuel increases, such that the fuel pressure acting on the upper end face of the adjusting piston 12 is overcome by the valve needle as it continues to be displaced upward, thus opening additional injection ports as needed.

Because of the yielding stop of the adjusting piston 12 at the end of the injection, there is also a softer interception of the adjusting piston 12 as it returns to its initial position; as a result there is also less wear, and furthermore the dynamic moving force of the piston attains rapid closure of the needle, because the piston is capable of exceeding the force of the pre-stressed spring and thus increases the closing force acting upon the needle.

A further advantageous embodiment of the present invention provides that in at least the pressure plate or the spring support plate there is a collar-like cuff 22 in the form of a cylindrical holding wall which surrounds the tang of the needle 3 and/or of the adjusting piston 12 resting or stopping on it at a particular time. As a result, the stop for the tang engaging the particular spring support plate 16 and/or 9 is shifted into the interior of the spring support plate. The result is thus an additional holding effect exerted upon the spring support plate, beyond the compressive and holding action applied by the closing spring, so that tipping of the spring support plate is reliably avoided; at the same time, there is a substantial reduction in frictional influences.

In the exemplary embodiment of the spring support plate 9 shown in FIG. 1, there is a first, collar-like, upwardly extended supporting wall 22, which surrounds the stop 13 of the extension tang 12*a* of the adjusting piston 12, and a lower supporting wall 23, which in this case is extended upward to a lesser degree, for receiving the upstream needle tang 3*a*.

In an advantageous embodiment, the stop forming the pre-stroke is located on the spring support plate 9 below the resting place of the spring, which is formed by the outer annular face 24 on the spring support plate.

In the exemplary embodiment shown in FIG. 2, the upper spring support plate 16' has an inner annular wall 25 which protrudes in the manner of a collar and surrounds the extension tang 12*a* of the adjusting piston 12, which passes through the spring support plate 16*a*, and thus assures a fixed axial and radial position without any tendency toward lateral movement. The lower spring support plate 9' is embodied approximately identically to that of the exemplary embodiment of FIG. 1, with the sole difference that the stop between the adjusting piston extension and the spring support plate is located above the resting place of the spring.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines, particularly a cold-starting valve, having an inlet in a nozzle holder, a nozzle body provided with a fuel injection opening, a valve needle arranged to close said injection opening and to open counter to the force of a closing spring in said nozzle holder, an adjusting piston, said valve needle further being urged in a closing direction by an additional force via said adjusting piston subjected to a fuel inlet control pressure, said closing spring forming a yielding stop for said adjusting piston, an upper spring support plate which forms a stop between said closing spring and a collar on said adjusting piston, a lower spring support plate which supports one end of said closing spring, said lower spring support plate having a passageway bore which receives one end of an extension tang in which said one end of said extension tang acts as a pre-stroke for said valve needle, said adjusting piston collar being arranged to rest on said upper spring support plate, and a restoring spring being supported at one end on an annular holder on said adjusting piston extension tang which forms a step for the pre-stroke and supported on another end on said upper spring support plate, said restoring spring comprising a compression spring means which presses said adjusting piston in a direction of said valve needle to form a clearly defined stop for a pre-stroke ($h_1$) for said injection nozzle.

2. A fuel injection nozzle as defined by claim 1, characterized in that said collar of said adjusting piston rests on an annular protrusion of said upper spring support plate.

3. A fuel injection nozzle as defined by claim 1, characterized in that said restoring spring for said adjusting piston is disposed within a spring chamber formed by said nozzle holder and said closing spring for said valve needle surrounds said restoring spring.

4. A fuel injection nozzle as defined by claim 3, characterized in that at least one of said spring support plates on which said closing spring is supported has a collar means, said collar means arranged to surround a tang provided on said adjusting piston, and further wherein said tang engages said closing spring support plate.

5. A fuel injection nozzle as defined by claim 4, characterized in that said lower spring plate further includes oppositely disposed collar-like annular protrusions.

6. A fuel injection nozzle as defined by claim 5, characterized in that said stop on the lower end of said tang for said pre-stroke ($h_1$) formed by said lower spring support plate is disposed inside said spring support plate and below the support area for said spring.

7. A fuel injection nozzle as defined by claim 4, characterized in that said upper spring support plate has a downwardly oriented cylindrical annular wall which surrounds said tang of said adjusting piston.

8. A fuel injection nozzle as defined by claim 1, characterized in that said lower spring support plate on which said closing spring is supported has a collar means, said collar means arranged to surround said tang provided on said adjusting piston, and further wherein said tang engages said lower closing spring support plate.

9. A fuel injection nozzle as defined by claim 8, characterized in that said lower spring plate further includes oppositely disposed collar-like annular protrusions.

10. A fuel injection nozzle as defined by claim 9, characterized in that said stop on the lower end of said tang for said pre-stroke ($h_1$) formed by said lower spring support plate is disposed inside said lower spring support plate and on a plane below the support area for said spring.

11. A fuel injection nozzle as defined by claim 10, characterized in that said upper spring support plate has a downwardly oriented cylindrical annular wall which surrounds said tang of said adjusting piston.

* * * * *